US009718663B2

(12) United States Patent
Kadyk et al.

(10) Patent No.: US 9,718,663 B2
(45) Date of Patent: Aug. 1, 2017

(54) PRODUCT COOLING SYSTEM, METHOD AND APPARATUS TO REDUCE HEAT TRANSFER

(75) Inventors: Jeffery W. Kadyk, Springfield, IL (US); Sheryl L. Dyer, Springfield, IL (US)

(73) Assignee: Bunn-O-Matic Corporation, Springfield, IL (US)

( * ) Notice: Subject to any disclaimer, the term of this patent is extended or adjusted under 35 U.S.C. 154(b) by 360 days.

(21) Appl. No.: 13/516,293

(22) PCT Filed: Dec. 16, 2010

(86) PCT No.: PCT/US2010/060870

§ 371 (c)(1),
(2), (4) Date: Jun. 15, 2012

(87) PCT Pub. No.: WO2011/075600

PCT Pub. Date: Jun. 23, 2011

(65) Prior Publication Data

US 2012/0258227 A1 Oct. 11, 2012

Related U.S. Application Data

(60) Provisional application No. 61/287,081, filed on Dec. 16, 2009.

(51) Int. Cl.

| | |
|---|---|
| ***B67D 7/80*** | (2010.01) |
| ***B67D 1/08*** | (2006.01) |
| ***B67D 1/10*** | (2006.01) |
| ***B67D 1/16*** | (2006.01) |

(52) U.S. Cl.

CPC ..... *B67D 1/0861* (2013.01); *B67D 1/108* (2013.01); *B67D 1/16* (2013.01); *B67D 2001/082* (2013.01); *B67D 2210/00044* (2013.01)

(58) Field of Classification Search

CPC .... B67D 1/0004; B65D 35/56; B65D 35/565; F25D 23/061; F25D 23/063; F25D 23/066; F25D 23/068

USPC ..... 222/129–129.4, 135, 146.6, 132

See application file for complete search history.

(56) References Cited

U.S. PATENT DOCUMENTS

| | | | | |
|---|---|---|---|---|
| 2,608,837 | A | | 9/1952 | Leland |
| 3,335,653 | A | * | 8/1967 | Heimann ..... 454/90 |
| 4,913,713 | A | | 4/1990 | Bender et al. |
| 5,564,601 | A | | 10/1996 | Cleland et al. |

(Continued)

OTHER PUBLICATIONS

Search Report and Written Opinion issued in PCT/US2010/060870 (2011).

*Primary Examiner* — Jianying Atkisson
*Assistant Examiner* — Antonio R Febles
(74) *Attorney, Agent, or Firm* — Barnes & Thornburg LLP

(57) ABSTRACT

A beverage dispensing apparatus including a cabinet for retaining a beverage product and from which the beverage product is controllably dispensed. The cabinet includes structures and systems to make cooling more efficient and maintain more constant product temperatures. The structures and systems function to reduce heat transfer between beverage product stored in containers in the cabinet and the ambient environment. The apparatus maintains a minimal equipment footprint, maintains ease of installing and removing the beverage containers, and accommodates a variety of types of products and types of product containers.

20 Claims, 3 Drawing Sheets

(56) References Cited

U.S. PATENT DOCUMENTS

| | | | | |
|---|---|---|---|---|
| 2002/0121527 | A1* | 9/2002 | Good | 222/94 |
| 2003/0089740 | A1* | 5/2003 | Gutierrez et al. | 222/146.5 |
| 2007/0131711 | A1* | 6/2007 | Minard et al. | 222/105 |
| 2008/0118378 | A1* | 5/2008 | Baron et al. | 417/412 |
| 2009/0238931 | A1* | 9/2009 | Herrick et al. | 426/249 |

* cited by examiner

PRODUCT COOLING SYSTEM, METHOD AND APPARATUS TO REDUCE HEAT TRANSFER

CROSS REFERENCE TO RELATED APPLICATIONS

The present application is a U.S. Nationalization of international patent application no. PCT/US2010/060870, filed Dec. 16, 2010, which claims priority under 35 U.S.C. §119(e) to U.S. Provisional Patent Application No. 61/287,081, filed Dec. 16, 2009. The disclosure set forth in the referenced applications are expressly incorporated herein by reference in their entireties, including all information as originally submitted to the United States Patent and Trademark Office.

BACKGROUND

A beverage dispensing apparatus including a cabinet for retaining a beverage product and from which the beverage product is controllably dispensed. In particular, the disclosure relates to improvements in structures of such apparatus to make cooling more efficient and maintain more constant product temperatures. These improvements are achieved while still maintaining minimal equipment footprint, maintaining ease of installing and removing the beverage containers, and accommodating a variety of types of products and types of product containers.

By way of background, some beverage products, such as juice, dairy-based beverages, and other beverage food concentrates are retained in a chilled condition. Such beverage products are retained in a product cabinet of a beverage dispensing apparatus which is cooled for convenient storage and controlled on demand dispensing. Cooling may provided using a variety of techniques including removing heat by way of air conditioning, ice banks, or other cooling systems. Regardless of the cooling techniques or systems used, the temperature of the product retained in the cabinet should be maintained in a generally consistent reduced temperature. This may be desirable to at least maintain favorable characteristics of the product. For example, product life of the beverage product may be maintained through cooling, flavor characteristics might be maintained, as well as color characteristics.

An example of a beverage product that might be retained in a cooling cabinet of a beverage dispensing apparatus or beverage dispenser is an orange juice concentrate. Orange juice is provided to the beverage dispenser in a concentrated form. In other words, the concentrated orange juice beverage product is packaged, retained in a product container and stored in a beverage dispensing apparatus for on demand controlled mixed with water when dispensed to reconstitute a juice beverage. Beverage concentrates help to at least reduce the cost of shipping product by reducing the proportion of water bulk and weight in the product and allowing the water to be added to the concentrate on site when dispensing to produce a reconstituted beverage.

In order to help maintain desirable characteristics, the concentrate is packaged in sealed containers such as plastic containers referred to as "caddies" or bag-in-box (BIB) containers. A product stored in a more bag-like container may also be used. Generally, such bag-like containers can be transferred to a caddie for use in beverage dispensing apparatus. The containers generally retain the concentrate in a sealed condition until it is placed in the juice cabinet and connected to a water line for controlled dispensing and mixing. Similarly, the BIB packaging contains the juice concentrate in a sealed container. BIB packaging may include a cardboard box or other container providing some degree of structural support for the flexible plastic bag retained in the box. Both the caddie and the BIB packaging or containers include fitments or connectors which can be connected to a dispensing nozzle, water source, and equipment used to dispense and mix the concentrate.

Such beverage product concentrates need to be maintained at a consistent temperature based on food product sales requirements. The containers, when placed in the cabinet cavity may swell, bow, or flex outward. Since several containers may be placed in the same cabinet the outermost containers, those placed along the inside wall surfaces of the cabinet, tend to contact the inside walls of the cabinet. This provides a relatively large potential contact area which can have a potentially negative effect on the product temperature. Contact between the container wall and the inside wall of the cabinet prevents airflow around the container. Additionally, the contact between the container wall and the inside wall of the cabinet provides a potentially, relatively large contact area permitting heat transfer between the wall and the product through the container wall. While insulation is provided in the cabinet walls, a significant temperature difference may occur between the product container in an exterior position of a group of containers and interiorly positioned containers. The temperature differential may be of several degrees which could be undesirable for maintaining product characteristics.

This background information is provided to provide some information believed by the applicant to be of possible relevance to the present disclosure. No admission is intended, nor should such admission be inferred or construed, that any of the preceding information constitutes prior art against the present invention. Other aims, objects, advantages and features of the invention will become more apparent upon reading of the following non-restrictive description of specific embodiments thereof, given by way of example only with reference to the accompanying drawings.

BRIEF DESCRIPTION OF THE DRAWINGS

The present disclosure will be described hereafter with reference to the attached drawings which are given as a non-limiting example only, in which.

Figure 1:
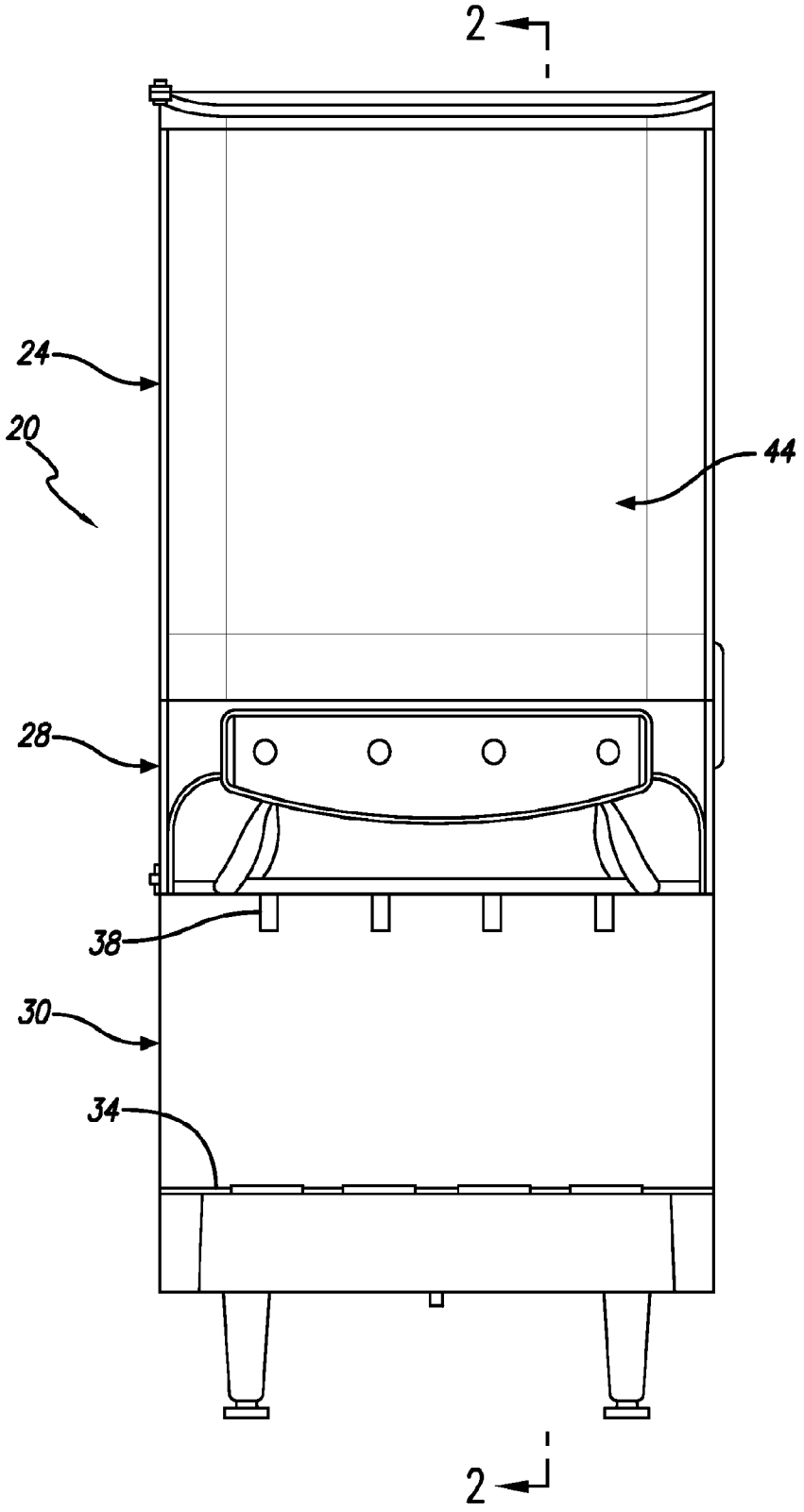
FIG. 1 is a front plan view of a beverage dispensing apparatus, showing a dispensing area positioned proximate to and below a cooled cabinet portion, the dispensing area having a control panel positioned proximate to and above dispensing nozzles.

The exemplification set out herein illustrates embodiments of the disclosure that are not to be construed as limiting the scope of the disclosure in any manner. Additional features of the present disclosure will become apparent to those skilled in the art upon consideration of the following detailed description of illustrative embodiments exemplifying the best mode of carrying out the disclosure as presently perceived.

DETAILED DESCRIPTION

While the present disclosure may be susceptible to embodiment in different forms, there is shown in the drawings, and herein will be described in detail, embodiments with the understanding that the present description is to be considered an exemplification of the principles of the disclosure. The disclosure is not limited in its application to the details of structure, function, construction, or the arrangement of components set forth in the following description or illustrated in the drawings. The disclosure is capable of other embodiments and of being practiced or of being carried out in various ways. Also, it is to be understood that the phraseology and terminology used herein is for the purpose of description and should not be regarded as limiting. The use of various phrases and terms is meant to encompass the items or functions identified and equivalents thereof as well as additional items or functions. Unless limited otherwise, various phrases, terms, and variations thereof herein are used broadly and encompass all variations of such phrases and terms. Furthermore, and as described in subsequent paragraphs, the specific configurations illustrated in the drawings are intended to exemplify embodiments of the disclosure. However, other alternative structures, functions, and configurations are possible which are considered to be within the teachings of the present disclosure. Furthermore, unless otherwise indicated, the term "or" is to be considered inclusive.

With reference to FIG. 1, a beverage dispensing apparatus 20 is shown. The apparatus 20 includes an upper cabinet area 24, a control area 28, and a dispensing area 30. The dispensing area 30 includes a cup ledge 34 and overhanging dispensing nozzles 38 positioned above the cup ledge 34. A beverage product 40 (see FIGS. 2 and 3) is retained in the upper cabinet area 24 behind a door 44 positioned on the front of the cabinet 24.

Figure 2:
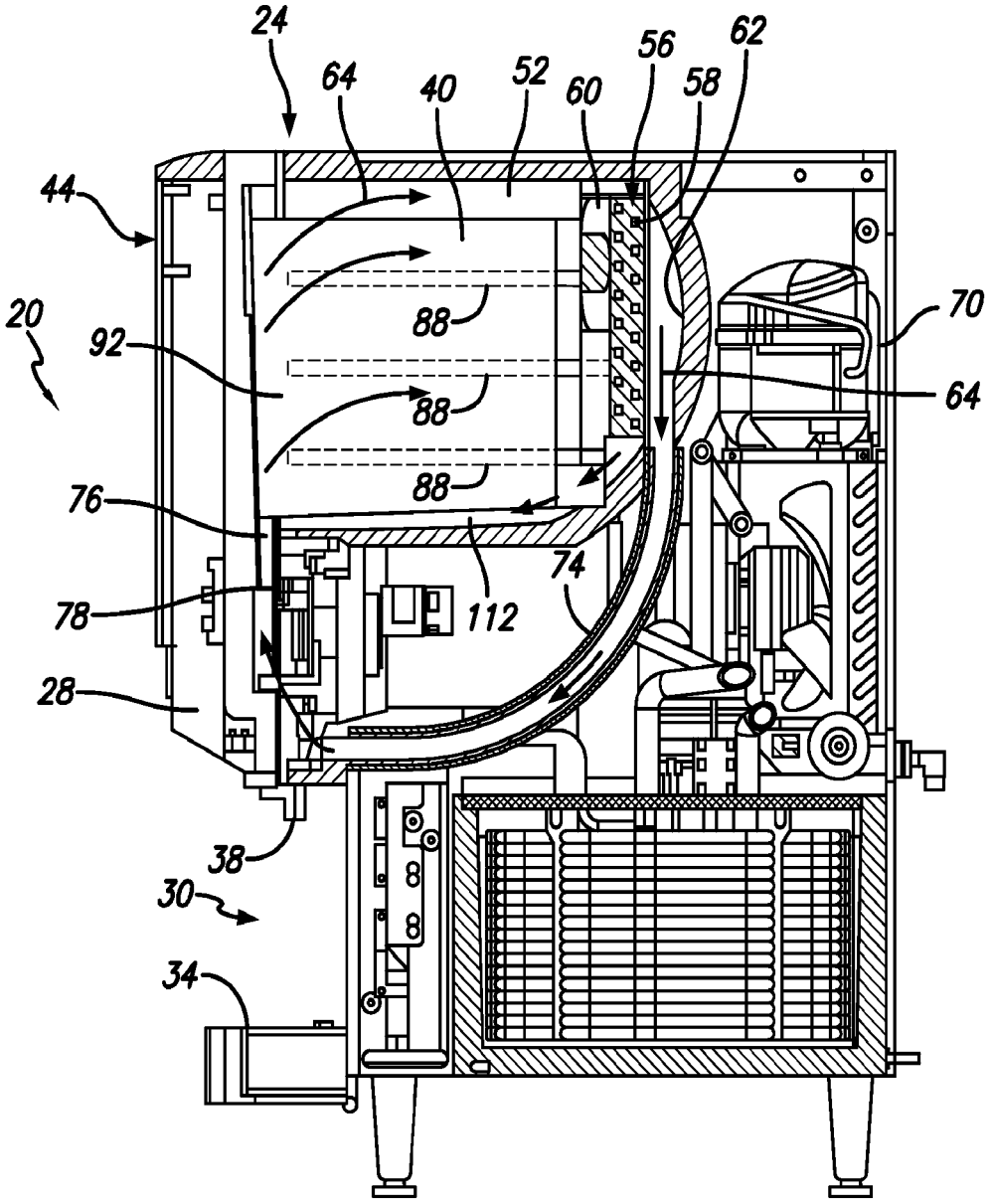
FIG. 2 is a cross sectional side elevational view of the apparatus in FIG. 1, in which the view is taken along line 2-2 in FIG. 1 to illustrate interior structures, configurations, and associated functions including air flow and circulation paths to provide for circulating cooling air around product containers retained in the cabinet.
Figure 3:
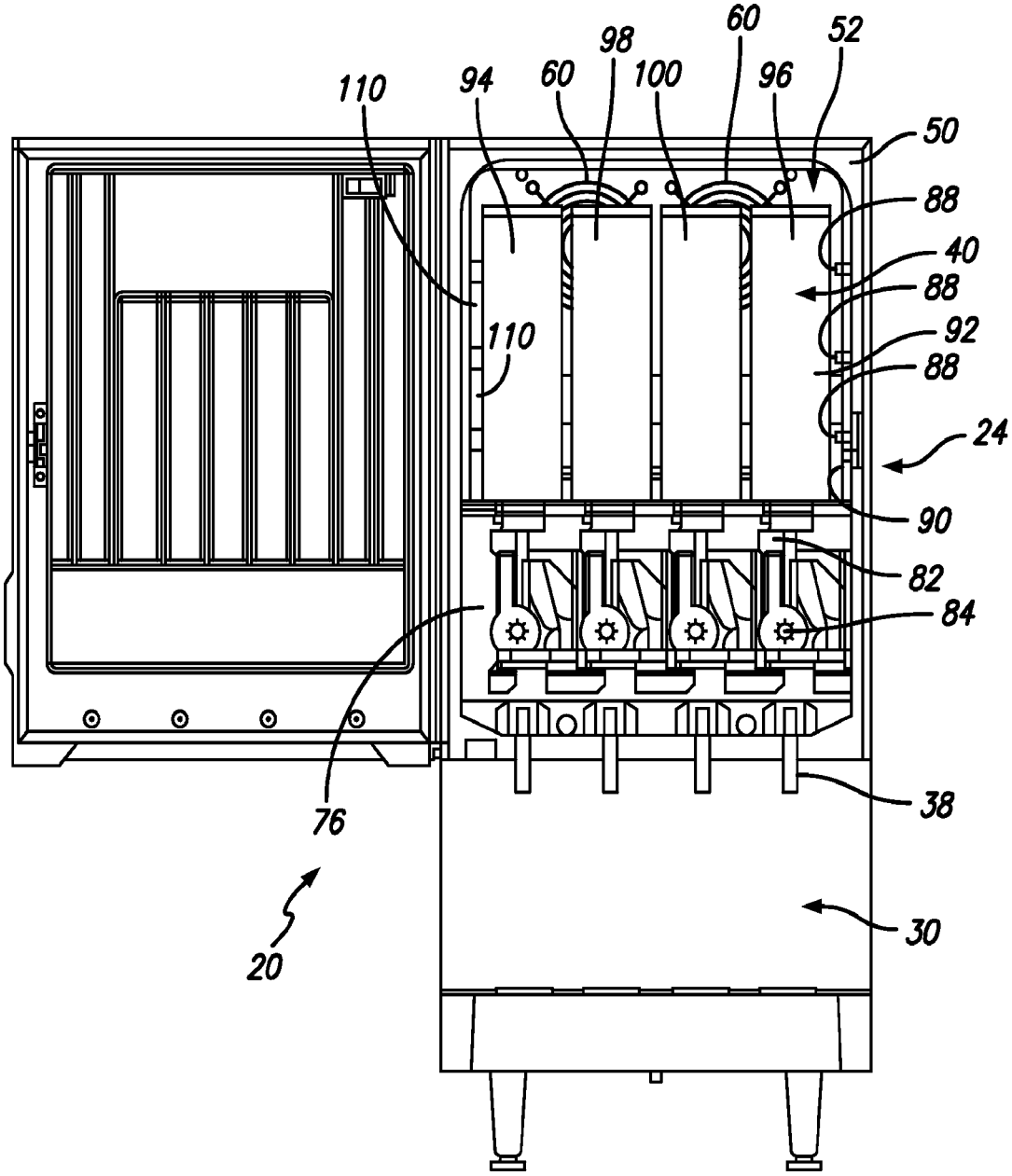
FIG. 3 is a front elevational view of the apparatus with a front door of the apparatus opened to illustrate the interior structures, configurations and associated functions of the cabinet.

With reference to FIG. 2, the apparatus 20 as shown in a cross-sectional view taken along line 2-2 in FIG. 1. The cross-sectional view shows a beverage product container 40 positioned inside of the upper cabinet area 24 behind the door 44. With further reference to FIG. 3, the upper cabinet area 24 includes an insulated wall 50. The insulated wall defines a cavity 52 which is sized and dimensioned for retaining a beverage product container. A cooling unit 56 is positioned for communication with the cavity 52 to provide controlled cooling of the cavity 52. Cooling coils 58 run through the cooling unit 56 and fans 60 blow against the cooling coils 58. As such the direction of flow of the fan driven air is towards the rear curved area 62 of the cavity 52. This rear directional flow of air 64 is a reduced temperature. The temperature is as a result of the heat exchange created by the cooling system 70.

Air 64 cooled by the cooling unit 56 is directed into a directional channel 74. The directional channel connects the curved rear area 62 of the cavity 52 with a front area 76 of the cavity. Air exits the channels 74 in a direction upwardly over the product dispensing area 78. The product dispensing area includes tubes 82 coupled to the product containers 40 and configured for use with a peristaltic pump 84. The tubes provide the dispensing nozzle 38 in the dispensing area 30. Passage of the cooled air through this dispensing area 76 helps to maintain the product, which is not retained in the container, such as the product fitting in the tubes, remains chilled at a desirable temperature to maintain various beverage characteristics. The protrusions may also be retrofitted into an existing cabinet by attachment to an inside surface of the wall by adhesive, fasteners or other means of attachment. The protrusions may also be provided on a panel which is attached to the inside wall of the cabinet cavity.

At least one protrusion 88, illustrated in the form of ribs 88 are provided on an inside surface 90 of the wall 50. These ribs 88 provide a structural member to space the product container walls away from the insider surface 90. Even if the container 40 tends to sag, bow or otherwise become distorted towards the inside surface 90 of the wall 50, the ribs 88 will help maintain a space between the outside surface of the container 40 and the inside surface 90 of the dispenser wall 50. The air 64 continues to flow around the containers 40 and back to the fans 60.

As such, the ribs 88 help to prevent heat exchange between the wall 50 and the outside surfaces 92 of the containers 40. This helps to maintain the temperature of the outside containers 94, 96 at approximately the same temperature as the inner containers 98, 100. Air is recirculated through the cavity 52 in the path as described. The protrusions 88 are shown as ribs but could be provided in a variety of other embodiments that provide a structure to space the product container walls away form the inside surface of the cavity. Reference to protrusions 88 is to be broadly interpreted to include ribs and all variations of other protrusions, regardless of whether they can be identified or defined as ribs, as long as these structures provide the spacing function needed to help maintain a preferred, desired, or required product temperature.

In use, a user places a beverage container 40 into the cavity 52 of the apparatus 20. Once placed in the cavity, the door 44 is closed. The cooling cycle is initiated whereby the cooling unit 70 operates to reduce the temperature of material flowing through the cooling coils 58. Fans 60 of the cooling assembly 56 blow across the coils to reduce the temperature of air moved by the fans 60. Air flows through the cooling assembly 56 in through the channel 74. In other words, the fans 60 force a flow pattern of the air 64 flowing through the cavity 52. The air 64 flowing from the channel 74 flows past the dispensing assembly 78 and up around the container 40 outside the surfaces 92.

The walls 50 include the protruding ribs 88 positioned thereon. The ribs 88 extend marginally outwardly away from the inside surface 90 of the cabinet 24 to help provide a passage between the outside surface 92 of the product wall and the inside surface of the cabinet wall. The ribs 88 provide channels 110 defined by the ribs 88, the outside surfaces 92 of the packaging containers 40, and the inside surface 90 of the cabinet walls, to promote airflow 64 there between. Also, the ribs 88 significantly reduce the potential contact area between the product packaging and the cabinet. Similarly, ribs 112 can be provided on a bottom surface of the cabinet to allow airflow underneath the product packaging containers. The ribs 88 can be directionally oriented, as shown by way of illustration and not limitation to help induce directional flow of air along the packaging. Similarly, airflow can be directed by way of the blowing of cooled air or suction of cooled air through the cabinet.

In at least one configuration, the airflow can be directed from the rear of the cabinet 62, through a passage 74 along the bottom of the product packaging, upwardly along the front face of the packaging and back through the upper, rear portion of the cabinet cavity 52. This airflow may be desirable so as to provide cooled air towards the front portion of the cabinet where the connectors or fitments are connected to the product packaging. This helps provide cooling in the front portion 78 where the product may be dispensed and slightly exposed to elevated temperatures where the product tube 82 passes from the cabinet towards the ambient atmosphere.

While the present disclosure describes various exemplary embodiments, the disclosure is not so limited. To the contrary, the disclosure is intended to cover various modifications, uses, adaptations, and equivalent arrangements based on the principles disclosed. Further, this application is intended to cover such departures from the present disclosure as come within at least the known or customary practice within the art to which it pertains. It is envisioned that those skilled in the art may devise various modifications and equivalent structures and functions without departing from the spirit and scope of the disclosure as recited in the following claims. The scope of the following claims is to be accorded the broadest interpretation so as to encompass all such modifications and equivalent structures and functions.

The invention claimed is:

1. A countertop beverage dispensing apparatus including a beverage dispensing area comprising a beverage dispensing nozzle, a cabinet having generally vertical side walls defining a cavity sized for retaining at least one beverage product container, a cooling unit is associated with the cabinet for communication with the cavity to provide controllable cooling of the cavity and the at least one beverage product container retained therein, opposing inside surfaces of the cavity generally vertical side walls including at least one generally horizontally oriented protrusion on each of the opposing inside surfaces of the cavity generally vertical side walls for spacing the at least one beverage product container away from substantial direct contact with the inside surface of at least a corresponding one of the generally vertical side walls, the generally horizontally oriented protrusion on each of the opposing inside surfaces of the cavity generally vertical side walls forming a generally horizontal channel for conveying cooling air in a first generally horizontal direction, a directional channel for conveying cooling air exiting one end of the generally horizontal channel downward and in a direction opposite the first generally horizontal direction, the cooling unit circulating air through the cavity of the cabinet with the at least one generally horizontally oriented protrusion providing space between the at least one beverage product container placed in the cavity and the inside surface of a generally vertical side wall of the cabinet with the space being open at the top and the bottom to allow circulation of air completely around the side walls of the at least one beverage product container.

2. A method of maintaining at least a predetermined temperature range associated with a product stored in a beverage dispensing apparatus, the method including the steps of:

providing a beverage dispensing apparatus including a cabinet having side walls extending vertically and defining a cavity therein;

providing at least one protrusion elongated generally horizontally on an inside surface of opposed inside surfaces of the cavity sidewalls;

providing a cooling unit associated with the cabinet;

using the cooling unit to circulate air through the cavity of the cabinet;

placing at least one product container in the cabinet with an outside of the at least one product container abutting the at least one protrusion to provide a space between the at least one product container and the cabinet to facilitate horizontal movement of air by the cooling unit and prevent heat transfer between the at least one product container and the cabinet with the space being open at the top and the bottom to allow circulation of air completely around the side walls of the product container, providing a beverage dispensing area for dispensing beverage from the at least one product container, and using the cooling unit to circulate air through the beverage dispensing area.

3. A protrusion elongated generally horizontally for use in a beverage dispensing cabinet, the protrusion elongated generally horizontally including two protrusions forming a cooling channel elongated generally horizontally in a first horizontal direction, the protrusions being sized and dimensioned for attachment to an inside surface of generally vertical side walls of the beverage dispensing apparatus cabinet, the two protrusions elongated generally horizontally being sized and dimensioned to provide a gap between an outside surface of a product container placed in the cabinet and a corresponding inside surface of the cabinet side wall to which the generally horizontally oriented protrusions are attached with the gap being open at the top and the bottom to allow circulation of air completely around the side walls of the product container, and a directional channel exiting one end of the cooling channel, the directional channel extending downward and in a direction opposite the first horizontal direction.

4. The protrusion device as in claim 3 further comprising the at least one protrusion is provided as a linear rib which is attached to the inside surface of the cabinet side walls of the beverage apparatus.

5. The protrusion device of claim 3 further comprising a panel having at least the one protrusion extending from the panel, the panel being sized and dimensioned for attachment to the inside surface of the side walls of the cabinet of a beverage dispensing apparatus.

6. The countertop beverage dispensing apparatus of claim 1, further comprising the generally horizontally oriented protrusion in the form of at least one elongate rib on each of two opposed sidewalls to position the at least one product container positioned near a corresponding side wall away from the inside surface of the corresponding sidewall to provide a path for circulation of air between the outside of the at least one product container and the corresponding inside surface of the sidewall.

7. The countertop beverage dispensing apparatus of claim 1, further comprising the generally horizontally oriented protrusion in the form of at least a pair of elongate ribs on each of two opposed sidewalls, the pair of ribs on a corresponding side wall being spaced apart on the side wall, the ribs being oriented to position the at least one product container positioned near the corresponding side wall away from the inside surface of the corresponding sidewall to provide a path for circulation of air between the outside of the at least one product container and the corresponding inside surface of the side wall.

8. The countertop beverage dispensing apparatus of claim 1, further comprising the generally horizontally oriented protrusion in the form of at least one elongate rib on each of two opposed sidewalls to position the at least one product container positioned near a corresponding side wall away from the inside surface of the corresponding sidewall to provide a path for circulation of air between the outside of the at least one product container and the corresponding inside surface of the sidewall and including at least one rib along a bottom wall for spacing a bottom surface of the at least one product container from the corresponding inside surface of the bottom wall to provide a path for circulation of air between the outside of the at least one product container and the corresponding inside surface of the bottom wall.

9. The countertop beverage dispensing apparatus of claim 1, further comprising the generally horizontally oriented protrusion in the form of at least one elongate generally horizontally oriented rib on each of two opposed sidewalls to position the at least one product container positioned near a corresponding side wall away from the inside surface of the corresponding sidewall to provide a path for circulation of air between the outside of the at least one product container and the corresponding inside surface of the sidewall.

10. A method of maintaining at least a predetermined temperature range associated with a product stored in a countertop beverage dispensing apparatus of claim 2, the method further including the steps of:

providing the at least one protrusion elongated generally horizontally in the form of at least one elongate rib;

positioning the at least one elongate ribs on each of two opposed sidewalls;

using the at least one elongate rib to define a gap between an outside surface of the product container and a corresponding inside surface of the side wall with the space being open at the top and the bottom to allow circulation of air completely around the side walls of the container; and circulating air through the gap between the outside of the at least one product container and the corresponding inside surface of the sidewall.

11. A method of maintaining at least a predetermined temperature range associated with a product stored in a countertop beverage dispensing apparatus of claim 2, the method further including the steps of:

providing the at least one protrusion elongated generally horizontally in the form of at least a pair of elongate ribs;

orienting the at least pair of elongate ribs on each of two opposed sidewalls;

using the at least pair of elongate ribs to define a gap between an outside surface of the product container and a corresponding inside surface of the side wall; and circulating air through the gap between the outside of the at least one product container and the corresponding inside surface of the sidewall.

12. A method of maintaining at least a predetermined temperature range associated with a product stored in a countertop beverage dispensing apparatus of claim 2, the method further including the steps of:

providing the generally horizontally oriented protrusion in the form of at least one elongate rib;

positioning the at least one elongate ribs on each of two opposed sidewalls;

using the at least one elongate rib to define a gap between an outside surface of the product container and a corresponding inside surface of the side wall;

using the at least one elongate rib to define a gap between an outside surface of the product container and a corresponding inside surface of the bottom side wall;

circulating air through the gap between the outside of the at least one product container and the corresponding inside surface of the sidewall and the corresponding inside surface of the bottom side wall.

13. The countertop beverage dispensing apparatus of claim 1, wherein the cavity further comprises a front and a rear, and wherein the cooling unit comprises at least one fan that directs cooling air sequentially from the front through the generally horizontal channel toward the back, along the directional channel downward toward the front, into the beverage dispensing area and up around the beverage product container.

14. The countertop beverage dispensing apparatus of claim 1, wherein the directional channel for conveying cooling air conveys cooling air to the beverage dispensing area.

15. The countertop beverage dispensing apparatus of claim 1, wherein the cooling unit comprises at least one fan that directs cooling air sequentially through the generally horizontal channel, the directional channel and the beverage dispensing area.

16. The countertop beverage dispensing apparatus of claim 15, wherein the at least one fan effects continuous cooling air flow around the at least one beverage product container.

17. The countertop beverage dispensing apparatus of claim 15, wherein the cabinet comprises a plurality of beverage product containers and the at least one fan effects continuous cooling air flow around the beverage product containers so that the beverage product containers are maintained at approximately the same temperature.

18. The countertop beverage dispensing apparatus of claim 1, wherein the at least one horizontally oriented protrusion comprises a rib.

19. The countertop beverage dispensing apparatus of claim 1, wherein the beverage dispensing nozzle is coupled to the at least one beverage product container for providing beverage from the beverage product container to the beverage dispensing nozzle.

20. The countertop beverage dispensing apparatus of claim 19, wherein a tube in the circulation of air connects the beverage dispensing nozzle and the at least one beverage product container for providing beverage from the beverage product container to the beverage dispensing nozzle.

* * * * *